United States Patent [19]

Scalia

[11] Patent Number: 4,787,177

[45] Date of Patent: Nov. 29, 1988

[54] TOOLHOLDER FOR GRINDING FLAT TIP OF SCREWDRIVER INTO HOLLOW GROUND SHAPE

[76] Inventor: Carmine J. Scalia, 43 Ridge St., Cos Cob, Conn. 06807

[21] Appl. No.: 935,044

[22] Filed: Nov. 26, 1986

[51] Int. Cl.[4] ..... B24B 19/00

[52] U.S. Cl. ..... 51/217 R; 51/220; 51/221 R; 269/91; 269/303

[58] Field of Search ..... 51/220, 221 R, 221 BS, 51/219 R, 217 A, 217 T, 217 P, 217 R, 218 T; 269/43, 91, 93, 268, 303

[56] References Cited

U.S. PATENT DOCUMENTS

| | | | |
|---|---|---|---|
| 1,899,489 | 2/1933 | Wickbergh | 81/441 |
| 2,317,996 | 5/1943 | Landg | 51/220 |
| 2,362,306 | 11/1944 | Ringzelli | 51/220 |
| 2,367,494 | 1/1945 | Gebel | 51/220 |
| 2,604,738 | 7/1952 | Ramey | 51/221 R |
| 2,635,398 | 4/1953 | Sohn | 51/221 R |
| 2,893,179 | 7/1959 | Sperow | 51/221 R |
| 4,338,749 | 7/1982 | Kiser | 51/220 |

*Primary Examiner*—Frederick R. Schmidt
*Assistant Examiner*—Robert Showalter
*Attorney, Agent, or Firm*—Andrew S. Langsam

[57] ABSTRACT

A toolholder for use in connection with the grinding of a conventional flat tipped screwdriver into a screwdriver having a hollow-ground tip configuration. The toolholder has a first section with a recess for receiving the round shank of the screwdriver, a second section having an inclined surface with respect to the top surface of the first section and an abutment ledge against which the front end of the screwdriver is located during grinding. A clamping lever is also provided, having a bottom located recess which lies over the shank of the screwdriver and, with suitable fastening mechanism, holds the screwdriver in place and against the abutment ledge for grinding. The angle of incline defined between the top surface of the first section and the flat bottom of the toolholder is slightly more than ¼ of the angle defined by the tip of the screwdriver. In addition, the angle of incline defined between the inclined surface of the second section and the top surface of the first section is equal to ½ of the angle defined by the tip of the screwdriver. The top edge of the abutment ledge is coplanar with the top surface of the first section of the toolholder.

6 Claims, 2 Drawing Sheets

TOOLHOLDER FOR GRINDING FLAT TIP OF SCREWDRIVER INTO HOLLOW GROUND SHAPE

BACKGROUND OF THE INVENTION

The present invention relates to a toolholder for use in connection with the grinding of conventional flat-tipped screwdrivers such that the driving tips are provided with a hollow ground shape. The toolholder is intended to maintain the screwdriver in a relative fixed position on a magnetic bed of a grinding machine. The bed, with toolholder and screwdriver held thereon are moved with respect to a grinding wheel of the machine which wheel has an outer circumferential grinding surface. By contacting the tip of the screwdriver against the circumferential grinding surface of the grinding wheel, a hollow ground configuration can be obtained from the otherwise flat tip of a screwdriver. Hollow ground tips for screwdrivers have been shown to have great advantages over conventional flat screwdriver tips in that the hollow ground tips substantially eliminate slipping or pulling out of the screwdriver tip from the slot of screws sought to be driven by the screwdriver and, correspondingly, hollow ground tips provide a much better "grip" between the screwdriver tip and the screw being driven. Less power is needed to maintain the tip of the screwdriver in the slot of the screw and, thus, more power can be used to drive the screw. The advantages of hollow ground screw tips for screwdrivers are well-known. However, screwdrivers, provided with hollow ground tips have not met with as wide spread commercial success as would be otherwise expected since the manufacture of the tips has, in the past, been relatively expensive, and, therefore the retail price to the ultimate consumer of these screwdrivers has not been able to be achieved at a sufficiently low price to warrant purchase. The present invention relates to a toolholder capable and intended to be used in mass producing hollow ground screw tips from conventional flat tip screwdrivers. It should be appreciated that the mass production in a minimum of time of these hollow ground screwdrivers can result in mass marketing of the screwdrivers with attendant decrease in unit cost. The present invention relates to a toolholder, i.e. a screwdriver holder, for use in connection with a magnetic movable bed used in connection with a grinding wheel for grinding the tip of a screwdriver into a hollow ground configuration.

BACKGROUND OF THE INVENTION

U.S. Pat. No. 1,889,489 issued Feb. 28, 1933 relates to a driving tip of a screwdriver having generally cylindrically concave surfaces ground into the flat sides of the tip (see FIGS. 7 and 8). More recently, this is referred to as a hollow ground configuration or shape. As best explained by the specification of that patent, the sides of the screwdriver are made slightly concave or hollow. Also according to the patent specification, if the concavity so provided is just great enough to free the center region of the screwdriver from contact with the sides of the slot of the of the screw sought to be driven by the screwdriver, a simple driver is provided that does not easily "jump away from the screw." Thus, the utility of a screwdriver having otherwise flat sides which have ground therein concave cylindrical surfaces, i.e. a hollow ground tip, and the advantages which are achieved are well-known in the art. The referred to patent, however, fails to discuss a toolholder capable of efficiently, inexpensively yet accurately producing mass quantities of hollow ground tips of otherwise flat tipped screwdrivers.

It is an object of the present invention to grind, efficiently, accurately, and economically, on a mass production level, conventional flat screwdrivers into screwdrivers having tips of hollow ground shape. The end product desired is, as mentioned, a screwdriver with a conventional handle and shank having a hollow ground configuration for the tip. The starting product is a conventional screwdriver with handle and shank having a flat screwdriver tip.

The present invention relates to a toolholder which is used in connection with a grinding wheel having a circumferential grinding surface which grinds the surface of the flat tip of a conventional screwdriver into a hollow ground configuration. The toolholder of the present invention, as will be more fully explained hereinafter, is preferably held on a magnetized bed such that the toolholder is fixedly secured thereon with the magnetized bed and the toolholder, holding the screwdriver in position, moving and reciprocating with respect to the rotating grinding wheel. In this way, mass quantities of hollow ground screwdrivers are efficiently and cheaply produced.

U.S. Pat. No. 4,338,749 issued July 13, 1982 relates to a toolholder and, specifically, relates to a toolholder for use in connection with a grinding wheel and a screwdriver originally having a flat tip. It is an object of the device shown in U.S. Pat. No. 4,338,749 to produce a hollow ground shape for the tip of an otherwise conventional flat and readily available screwdriver. The toolholder shown in this particular reference is a relatively complex device having multiple knobs, interlocking and meshing surfaces, etc. The device seems to call for high precision machining. The tolerance apparently required for this device to properly function is relatively small since the halves are intended to be matingly engageable and slidable with respect to one another, and, therefore, it is quite apparent that this particular toolholder is relatively complex to use and expensive to manufacture.

In addition, it should be appreciated that the toolholder shown in this reference patent is only capable of producing a single hollow ground screwdriver at a time and, in order to grind a second screwdriver, the first one must first be withdrawn and a new screwdriver inserted therein. Clearly, this involves a significant period of time (unscrewing two thumbscrews) and is far more complicated and time consuming than the toolholder of the present invention. Indeed, it is a specific aspect of an embodiment of the present invention to provide a simple to machine toolholder having a plurality of adjacently located recesses for maintaining, in relative fixed position, the shanks of a plurality of screwdrivers which are all intended to be ground such that their tips have the desired hollow ground configuration.

Also, it should be appreciated that the flat portions of the tip of the screwdriver when held in the toolholder of the U.S. Pat. No. 4,338,749 are held against the cylindrical outside circumferential edge of the grinding wheel in an orientation such that the shank is perpendicular to the axle of rotation of the grinding wheel. It is difficult to understand how orienting the screwdriver tip in this manner will result in a hollow ground configuration i.e., a screwdriver tip wherein the edges of the tip are thicker than the centermost portion of the screwdriver tip. (See FIG. 8 of the referenced U.S. Pat. No. 1,889,489). The present invention allows for a hollow ground configuration to be ground into the tip of an otherwise flat screwdriver while holding and grinding the shank of the screwdriver parallel to the axle of rotation of the grinding wheel. This will, of course, result in a true hollow ground shape depending upon the width of the top of the screwdriver and the radius of the grinding wheel.

In addition, U.S. Pat. No. 4,338,749 is principally directed to providing a toolholder for a screwdriver having V-shaped recesses for holding the rectangularly shaped shaft in position. After the first flat side of the screwdriver tip is ground down so that it exhibits the concave cylindrical circumferential surface, the entire block, holding the screwdriver, is flipped over for grinding the second flat surface. When the U.S. Pat. No. 4,338,749 toolholder is sought to be used with a round shaft of a screwdriver there is no mechanism for precisely aligning the flat portion of the tip of the screwdriver with the cylindrical surface of the grinding wheel to ensure minimum tip thickness at the center of the tip. If the alignment is not precisely done, in the beginning, then when U.S. Pat. No. 4,338,749 device is flipped over for grinding the the second flat side, it, too, will also be off center. Thus, use of the U.S. Pat. No. 4,338,749 toolholder does not guarantee that the minimum thickness of the tip of the hollow ground screwdriver occur at precisely the middle of the tip halfway between the edges of the flat screwdriver tip. In contrast, the present invention, on the other hand, provides a flat surface on which the flat screwdriver tip can rest and, in addition, an abutment ledge for pushing the screwdriver forwardly such that the flat faces of the screwdriver are precisely aligned for grinding by the cylindrical surface of the grinding wheel. In this way, the thinest part of the concave cylindrical surface ground into the flat tip of the screwdriver will coincide as desired, at precisely the middle between the side edges of the screwdriver tip.

U.S. Pat. No. 2,604,738 issued on July 29, 1952 also relates to a toolholder, Here, again, a device is shown for holding a conventionally available flat tipped screwdriver in relative fixed position for grinding by a guiding wheel. This reference, however, neither teaches nor suggests the efficient manner by which a flat tipped screwdriver can be ground on a grinding wheel to produce a hollow ground configuration in a quick, efficient and mass production manner. Indeed, the toolholder of this reference contemplates grinding of the edges of the screwdriver on a flat grinding stone to produce a flat tipped screwdriver (see FIG. 3).

U.S. Pat. No. 2,604,738, as mentioned, relates to a toolholder for a screwdriver which can be easily flipped over after the first flat side of the screwdriver tip has been ground down. Here, again, there is no mechanism for insuring that the grinding occurs such that the minimum thickness of the screwdriver tip occurs at precisely the middle between the side edges, i.e. a truly accurate hollow ground configuration is not necessarily obtained. Indeed, this reference neither teaches nor suggests providing the flat tip with a hollow ground configuration but, rather, appears to primarily relate to grinding the tip of the screwdriver to a true flat condition and, not, the hollow ground configuration, at all.

U.S. Pat. No. 2,604,738 does indicate that the flat elongated portion of the toolholder is provided with beveled edges or surfaces along its length whereby the positioning of the screwdriver with respect to the grinding stone may be effectively maintained, as seen best in FIG. 3. This apparently insures that the flat surface of the screwdriver be substantially flush against the flat surface of the grinding stone. In contrast, the present invention contemplates that the toolholder be machined such that an angle of incline is defined between the top surface of the first section of the toolholder having the recess for holding the screwdriver shank, and the bottom surface of the toolholder. In addition, a second angle of incline is provided to the toolholder of the present invention, which angle of incline is defined as the angle between the planes of the inclined surface of the second section where the tip of the screwdriver is placed for grinding and the top surface of the first section. According to the preferred embodiment of the present invention, the angles of incline just defined are precisely related to one another and to the angle defined by the flat planar faces of the screwdriver tip, in its non-ground condition.

SUMMARY OF THE INVENTION

The present invention relates to a toolholder for use in connection with grinding the otherwise flat planar surfaces of a tip of a conventional screwdriver into a hollow ground configuration by use of a grinding wheel having a circumferential grinding surface. The toolholder is preferably maintained on a magnitized bed which is adapted to move in relation to the rotating grinding wheel. According to the preferred embodiment of the present invention, the toolholder is provided with a plurality of recesses which are each capable of holding a screwdriver shank. These recesses are adjacently located to one another in a single toolholder so that a few screwdrivers can be manufactured with the hollow ground tip configuration in a minimum of time. The toolholder described herein is preferably machined from a block of suitable metal material and can be quickly and easily used to produce, on a mass production level, screwdrivers having hollow ground tip configuration from flat tipped screwdrivers. As previously mentioned, the hollow ground configuration for a screwdriver tip is extremely effective and substantially eliminates the problems inherent in flat screwdriver tips when they are turned or torqued against the flat surfaces of the slot of the screws which are sought to be driven by the screwdrivers.

The toolholder in its form for use in connection with a single screwdriver comprises a first section having a recess which holds the conventional cylindrically shaped shank of the screwdriver. According to another embodiment of the present invention, however, the recess can be V-shaped to accommodate rectangular shanks of conventional screwdrivers. The top surface of the first section which has the recess for holding the screwdriver shank is at an angle with respect to the bottom surface of the toolholder. According to the preferred embodiment of the present invention, this angle is slightly more than $\frac{1}{4}$ of the angle defined by the flat surfaces of the screwdriver which is sought to be ground into a hollow ground configuration.

A second section of the toolholder extends forwardly from the first section and has a coplanar bottom with the bottom of the first section. The second section has an inclined surface for supporting the tip of the screwdriver. The plane of the inclined surface and the plane of the top surface of the first section define a second angle of incline. This second angle of incline is preferably equal to one half of the angle defined by the flat sections of the screwdriver tip. By configuring the toolholder in this manner, the flat surfaces of the screwdriver are canted up to the grinding surface of the grinding wheel and the screwdriver tip is held substantially higher than the toolholder itself so that the grinding wheel will not merely grind the tip of the screwdriver but, rather the concave cylindrical surface ground into the screwdriver tip will extend an appreciable distance back beyond the forwardmost tip.

A clamping mechanism for holding the screwdriver shank onto the toolholder is also provided which basically comprises a threaded bolt held adjacent to the recess in the first section. This bolt is threaded and projects upwardly from the top surface of the first section. A clamping lever has an aperture which fits over the bolt and is secured in place by a nut which threadingly engages the threads of the bolt. The clamping lever has a laterally extending arm which has a recess located on its bottom which corresponds in shape to the shape of the screwdriver shank sought to be held in location. This recess overlays the recess of the first section and together they hold the shank in place. On the other side of the clamping lever and extending downwardly for contact with the top surface of the first section of the toolholder is a finger which maintains the clamping lever substantially parallel to the top surface of the first section and provides a fulcrum for providing leverage to hold the shank in position.

With the screwdriver held in position and the toolholder positioned and secured to the magnetic bed of the grinding machine, the screwdriver is brought towards the grinding wheel for grinding the hollow ground or concave surface into the first flat portion of the screwdriver tip. Of course, different size grinding wheels are suitable for grinding different width tips.

DETAILED DESCRIPTION OF THE INVENTION

Figure 1:
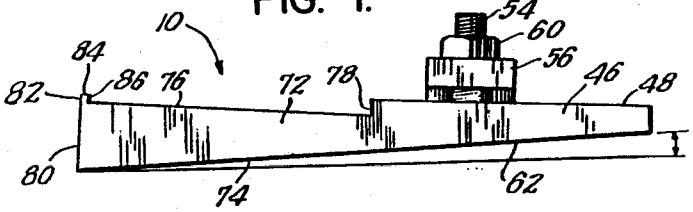
FIG. 1 is a side plan view of the toolholder of the present invention.
Figure 4:
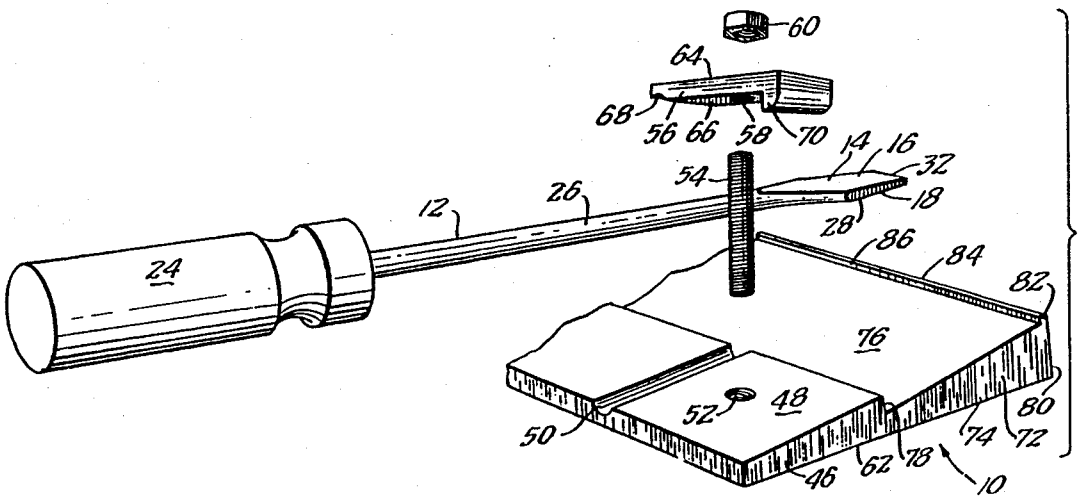
FIG. 4 is an exploded partial perspective view of the toolholder of the present invention and shows a conventional flat tipped screwdriver with cylindrical shank prior to placement in the recess of the toolholder.
Figure 2:
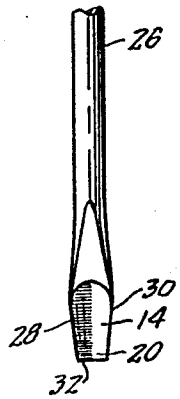
FIG. 2 is a partial top plan view of a screwdriver shank and tip after it has been ground into the hollow ground configuration.
Figure 3:
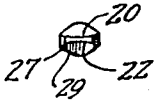
FIG. 3 is a front plan view of the screwdriver tip after it has been ground into the hollow ground configuration.

As best seen in FIGS. 1 and 4, a toolholder 10 is provided for facilitating grinding a conventional screwdriver 12 such that the tip 14 of the screwdriver is changed from a conventional tip having converging flat surfaces 16 and 18 into a tip having converging concave surfaces 20 and 22 (see FIGS. 2 and 3). The screwdriver has a conventional handle 24, a round or rectangular shank 26 and the tip 14 located at the end of the shank. The tip 14 of the screwdriver 12 has converging flat side edges 28 and 30 and a flat leading edge 32.

Figure 5:
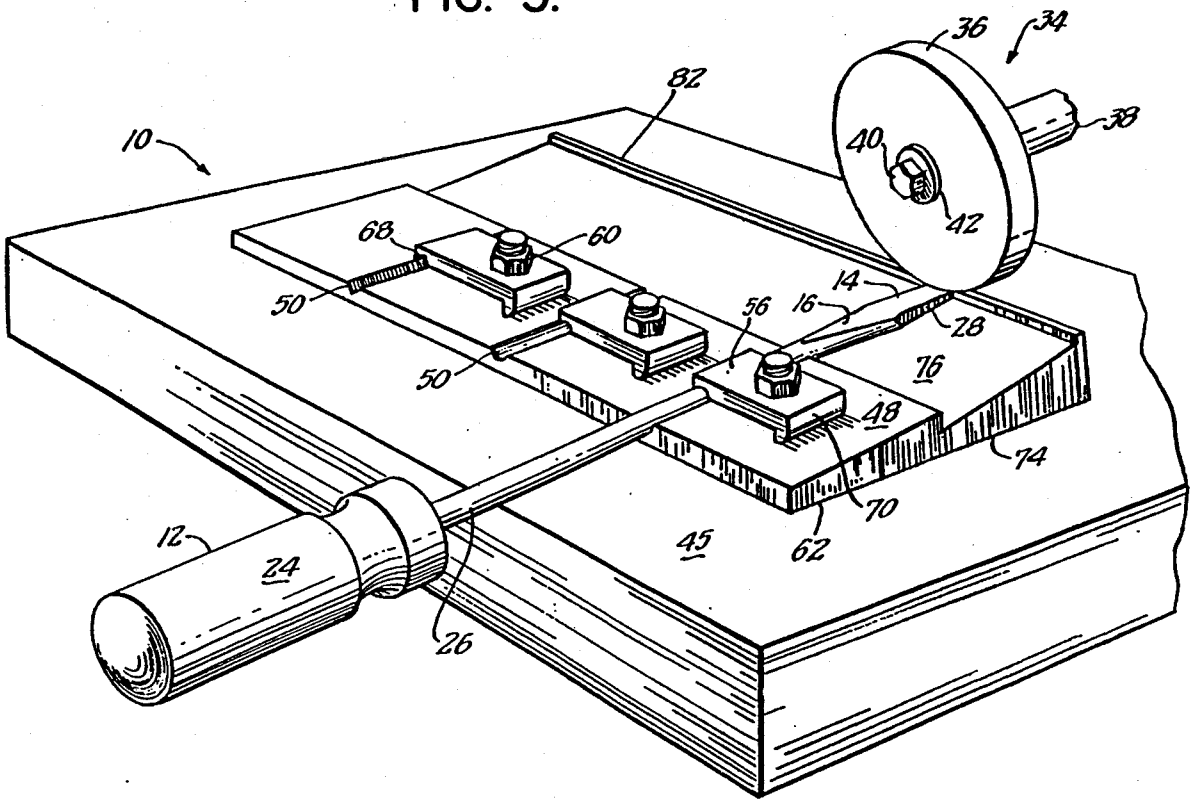
FIG. 5 is a partial perspective view of another embodiment of the toolholder of the present invention and shows a plurality of recesses and associated clamping mechanisms for holding a plurality of screwdrivers of different shaped shanks for grinding the tips of the screwdrivers into the hollow ground configuration by use of a cylindrical grinding wheel having a cylindrical circumferential grinding surface.

Turning attention to FIG. 5, for the moment, it will be appreciated that a grinding wheel 34 having a cylindrical circumferential grinding surface 36 is secured to a rotating axle 38 by a bolt 40 and washer 42 in a conventional, well-known manner. The rotating axle 38 is part of the grinding machine 44 (not shown). The grinding wheel and machine and its operating components are conventional and well-known in the art and form no part of the present invention. A magnetic toolholder supporting bed 45 is also shown in FIG. 5 and is also a part of the conventionally available grinding machine 44. It will be appreciated that the grinding wheel 34 can, as desired, be selectively changed to a grinding wheel having a different diameter in order to accomplish grinding a hollow ground configuration to differently sized flat tipped screwdrivers, i.e. screwdrivers having different widths for their leading edge. For example, it has been found in practice that a 6" diameter grinding wheel is suitable for providing a hollow ground tip configuration for a screwdriver having a leading edge width of 7/16 of an inch. When ground by this 6" diameter grinding wheel, the thickness of the leading edge 32 of the tip 14 of the screwdriver 12 is maximized at the outermost edge 27 of the tip and achieves a thickness of about 0.055 inches. The minimum thickness of the leading edge 32 of the screwdriver tip, when a 6" grinding wheel is utilized preferably occurs precisely at the middle 29 of the leading edge 32 of the screwdriver tip and it is approximately 0.045 inches. Correspondingly, a 4" diameter grinding wheel is suitable for providing a hollow ground tip configuration into a ¼ inch wide leading tip of a screwdriver. When so ground, the outside dimension of the outermost edges 27 of the leading edge of the screwdriver tip achieves 0.050 inches while the thickness of the middle 29 of the leading edge of the screwdriver tip will be 0.040 inches. A 3 inch diameter grinding wheel has been found suitable for grinding a 3/16 of an inch wide screwdriver tip such that the thickness of the leading edge of the tip, at the outermost edges 27 is about 0.045 inches while the thickness at the middle 29 of the leading edge of the screwdriver will be 0.035 inches. Finally, it has been found that a 1 inch diameter grinding wheel is suitable for providing a hollow ground configuration into a ⅛ inch wide screwdriver. When so ground, the thickness of the leading edge of the screwdriver tip, at the outermost edges 27 is about 0.040 inches while the thickness of the screwdriver tip at its middle 29 will be about 0.030 inches.

With specific reference to FIGS. 1 and 4, the toolholder 10, as mentioned, is machined, from a single block of metal material which material can be held, in place, on the magnetized bed 45 of a grinding machine 44. The toolholder 10 has a first section 46 for supporting the shank 26 of the screwdriver. The first section 46 has a flat inclined top surface 48 having at least one recess or cutout 50 which is suitable for receptively holding the shank 26 of a screwdriver 12. According to one embodiment of the invention, the recess 50 is semicylindrical so that it can easily hold round shanks 26 of various dimensioned screwdrivers. Alternatively, however, as best seen in FIG. 5, the recess 50 can be V-shaped, which allows the toolholder to hold shanks which are rectangular in shape. Secured within a drilled hole 52 (see FIG. 4) on the top surface 48 of the toolholder is a threaded bolt 54 which extends upwardly and is closely located adjacent to recess 50. A clamping lever 56, more fully explained hereinafter, has an aperture 58 approximately centrally located along the length and width of the clamping lever 56. The aperture 58 is sufficiently large so that the clamping lever 56 can easily be passed over and held on the bolt 54. A nut 60 having internal screw threads which matingly engage with the screw threads of bolt 54 serves to hold the clamping lever 56 on bolt 54.

The bottom 62 of the first section is magnetically held on the bed 45 of the grinding machine 44. A first angle of incline is defined by the planes of the top surface 48 of the first section 46 and the bottom 62 of the first section 46. Thus, when the toolholder 10 is placed on the magnetized bed 45 of the grinding machine 44, the top surface 48 of the first section 46 slopes upwardly from the handle 24 of the screwdriver 12 towards the grinding wheel 34. This, in effect, raises the tip of the screwdriver up towards the grinding wheel.

The clamping lever 56 has a lateral extension 64 which projects sidewise and extends over recess 50. The bottom surface 66 of the clamping lever 56 is preferably provided with a recess 68. According to the preferred embodiment of the present invention, the shape of the recess 68 of the clamping lever 56 corresponds to the shape of the shank 26 of the screwdriver 12. Thus, as best seen in FIG. 5, when the shank of the screwdriver is expected to be rectangular in shape, the recess 50 of the top surface 48 of first section 46 as well as recess 68 of clamping lever 56 are rectangularly shaped while in the embodiment shown in FIG. 4 the recess 50 of the top surface 48 of first section 46 and recess 68 of clamping lever 56 are circular in shape to accommodate the round shank 26 of screwdriver 12.

Extending from the bottom surface 66 of clamping lever 56 is a leverage providing finger 70. Leverage providing finger 70 extends downwardly and rests against the top surface 48 of first section 46 to thereby maintain that the top of the clamping lever 56 remains substantially parallel to the top surface 48 when the nut 60 is screwed down tightly onto bolt 54 and against the top of clamping lever 56. Of course, it should be appreciated that the length of the leverage providing finger 70 should be adequately sized so that the recess 68 of the lateral extension 64 of the clamping lever 56, when working in association with recess 50 of top surface 48 of first section 46, firmly and securely holds the shank 26 of the particular screwdriver which is to be ground.

A second section 72 of toolholder 10 has a co-planar bottom 74 with bottom 62 of first section 46. The second section 72 has an inclined surface 76 which extends from a front wall 78 of first section 46 and slopes upwardly toward the grinding wheel 34. A second angle of incline is thus defined between the plane of the inclined surface 76 and the bottom surface 74 (co-planar with bottom 62 of first section 46).

Located at the front end 80 of second section 72 and extending upwardly therefrom is a tip abutment ledge 82. The height that the tip abutment ledge 82 extends above the inclined surface 76 is, according to the preferred embodiment of the present invention, equal to or less than the thickness of the tip of the screwdriver at its leading edge 32 i.e., at the outermost edges 27. Also, according to the preferred embodiment, the top edge 84 of the tip abutment edge 82 is co-planar with the top surface 48 of first section 46. The leading edge 32 of the screwdriver 12, when the screwdriver is mounted on the toolholder 10, is pushed flushly against the rear wall 86 of the tip abutment ledge 82. When properly mounted, the shank 26 of the screwdriver is held between the recess 50 of the first section 46 and the recess 68 of the clamping lever 56 with the leading edge 32 of the screwdriver flush against the rear wall 86 of the abutment ledge 82.

According to the preferred embodiment of the present invention, the second angle of incline is precisely equal to 1/2 the angle defined by the planes of the flat surfaces 16 and 18 of the particular screwdriver 12 which is sought to be ground by the grinding machine 44. In this manner, one of the flat surfaces 16 or 18 will extend above the plane defined by the top surface 48 of first section 46 while the other flat surface of the screwdriver tip 14 will rest on the incline surface 76 of second section 72. Also, according to the preferred embodiment of the present invention, the first angle of incline, defined as the angle between the planes of the top surface 48 of first section 46 and the plane of bottoms 62 and 74 of first section and second section, respectively, is equal to slightly more than ¼ of the angle defined by the planes of the flat surfaces 16 and 18 of the screwdriver tip 14. In this manner, the circumferential grinding surface 36 of the grinding wheel 34 can easily and effectively grind the flat surfaces into the desired hollow ground configuration.

In practice, with a screwdriver tip having a 10° angle defined between the flat surfaces 16 and 18, the first angle of incline is machined to 3° while the second angle of incline is precisely machined to 5°.

As best seen in FIG. 5, a single toolholder 10 can be provided for grinding a plurality of screwdrivers 12, by having a plurality of adjacently located recesses 50 machined into a single first section 46, with a single longitudinally extending tip abutment ledge 82 being provided for all of the screwdrivers. In this manner, a plurality of screwdrivers can be quickly and easily mounted between the clamping levers and the recesses 50 of the first section 46 with the tips of the screwdrivers being pushed forwardly against the rear wall 86 of the tip abutment ledge 82 and then, individual tips can be ground into the desired hollow ground configuration with lateral machine indexing being provided to quickly and efficiently grind all of the first sides of the screwdrivers without shutting off the machine after each individual screwdriver is ground. Then, all screwdrivers can be flipped over and the second sides ground. Clearly, this is a significant advantage of the present invention.

After the first flat surface 16 of the tip 14 of the screwdriver 12 has been ground into the desired hollow ground shape or configuration, the nut 60 of the clamping mechanism can be unscrewed to release the shank 26 from being firmly maintained between the recess 50 and the recess 68 of the clamping lever 56. Then, the screwdriver handle can be rotated, 180°, so that the second flat surface 18 will be upwardly directed with the first, now concave surface 20, being directed toward the inclined surface 76. Then, the nut 60 can be screwed downwardly so that it pushes the clamping lever 56 down with the recess 68 holding the shank 26 down into the recess 50. Now, the grinding of the second flat surface 18 can be accomplished until it, too, achieves a hollow ground shape. After both sides have been ground, as desired, into the hollow ground shape, the screwdrivers can be removed from the machine and used with attendant beneficial results.

It should be understood, of course, that the specific form of the invention herein illustrated and described is intended to be representative only, as certain changes may be made therein without departing from the clear teachings of the disclosure. Accordingly, reference should be made to the following appended claims in determiing the full scope of the invention.

I claim:

1. A toolholder for use in grinding the flat angled planes of the driving tip of a screwdriver having a shank into a hollow ground shape by use of a grinding machine having a grinding wheel with a grinding circumferential surface and a toolholder bed for holding said toolholder while simultaneously moving said screwdriver, held by said toolholder, into grinding contact with said circumferential surface of said grinding wheel, comprising:

(a) a first section of said toolholder having a first top surface and a shaped recess cut therein for positioning said shank of said screwdriver;

(b) a shank holding means which cooperates with said recess for maintaining said shank of said screwdriver in fixed relative position on said toolholder;

(c) a second section of said toolholder adjacent to said first section and having a second top surface;

(d) said first section and said second section having coplanar bottom surfaces;

(e) a first angle of incline being defined between said first top surface of said first section and said coplanar bottom surfaces, first angle of incline being slightly greater than one quarter of the angle defined by the flat planes of said tip of said screwdriver; and (f) a flat screwdriver tip abutment ledge located at the front end of said second section and extending perpendicularly to said bottom of said second section, providing an abutment surface perpendicular to the axial line of said shank holding means preventing relative forward move- ment of said tip of said screwdriver secured in said toolholder, the height of said ledge being not more than the thickness of the front end of said tip of said screwdriver.

2. A toolholder as claimed in claim 1, wherein the top edge of said screwdriver tip abutment ledge is coplanar with said first top surface of said first section.

3. A toolholder as claimed in claim 1, wherein when said flat planes of the tip of the screwdriver define an angle of 10° and said first angle of incline is 3°.

4. A toolholder as claimed in claim 1, wherein the plane defined by said second top surface is at a second angle of incline with respect to the plane defined by said first top surface of said first section.

5. A toolholder as claimed in claim 4, wherein said second angle of incline is equal to one half of the angle defined by the flat planes of the tip of the screwdriver.

6. A toolholder as claimed in claim 4, wherein when said flat planes of the tip of the screwdriver define an angle of 10° and said second angle of incline is 5°.

* * * * *